US005635654A

United States Patent [19]

Hebsur et al.

[11] Patent Number: 5,635,654

[45] Date of Patent: Jun. 3, 1997

[54] NIAL-BASE COMPOSITE CONTAINING HIGH VOLUME FRACTION OF ALN FOR ADVANCED ENGINES

[75] Inventors: Mohan G. Hebsur; John D. Whittenberger, both of North Olmsted; Carl E. Lowell, Berea, all of Ohio

[73] Assignee: The United States of America as represented by the Administrator of the National Aeronautics and Space Administration, Washington, D.C.

[21] Appl. No.: 238,767

[22] Filed: May 5, 1994

[51] Int. Cl.[6] ..... C22C 21/00; B22F 3/00

[52] U.S. Cl. ..... 75/244; 75/249; 419/13; 419/32; 419/33

[58] Field of Search ..... 75/245, 249, 244; 419/33, 13, 32

[56] References Cited

U.S. PATENT DOCUMENTS 4,619,699 10/1986 Petkovic-Luton et al. ..... 75/252
4,961,905 10/1990 Law et al. ..... 420/460

OTHER PUBLICATIONS

Bowman, Randy R., "Influence of Interfacial Characteristics on the Mechanical Properties of Continuous Fiber Reinforced NiAl Composites," *Mat. Res. Soc. Symp. Proc.*, vol. 273, pp. 145–155.

Hebsur, M. G. et al., "Microstructure/Property Relations in Aln and $Al_2O_3$ Particulate Strengthened NiAl," *Mat. Res. Soc. Symp. Proc.*, vol. 288, pp. 1111–1116.

Bowman, Randy et al., "Unresolved Technical Barriers to the Development of a Structurally Viable $Al_2O_{23}$/NIAL Composite," *HITEMP*, NASA–CP–19117, 1993.

Luton, M.J. et al., "Cryomilling of Nano–Phase Dispersion Strengthened Aluminum," *Mat. Res. Soc. Symp. Proc.*, vol. 132, 1989, pp. 79–86.

Whittenberger, J. D. et al., "Preliminary investigation of a NiAl composite prepared by cryomilling," *J. Mater. Res.*, vol. 5, No. 2, Feb. 1990, pp. 271–277.

Aikin, B.J.M. et al., "Reproducibility of NiAl Cryomilling," *Mech. All. for Struct. App.*, Proc. 2nd Intl. Conf. Struct. Appl. Mech. All., Sep. 20–22 1993, pp. 283–290.

Whittenberger, J. D. et al., "1300 K compressive properties of a reaction milled NiAl–AlN composite," *J. Mater. Res.*, vol. 5, No. 12, Dec. 1990, pp. 2819–2827.

Lowell, Carl E. et al., "Cyclic Oxidation Resistance of a Reaction Milled NiAl–AlN Composite," *Mat. Res. Soc. Symp. Proc.*, vol. 194, 1990, pp. 355–360.

Whittenberger, J. Daniel, "Characteristics of an elevated temperature AlN particulate reinforced NiAL," *Structural Intermetallics*, Oct. 1993, pp. 819–828.

*Primary Examiner*—Ngoclan Mai
*Attorney, Agent, or Firm*—Gene E. Shook; James A. Mackin; Guy M. Miller

[57] ABSTRACT

A particulate reinforced NiAl-AlN composite alloy has a NiAl matrix and greater than about 13 volume percent fine particles of AlN within the matrix. The particles preferably have a diameter from about 15 nanometers to about 50 nanometers. The particulate reinforced NiAl-AlN composite alloy may be prepared by cryomilling prealloyed NiAl in liquid nitrogen using grinding media having a diameter of from about 2 mm to about 6 mm at an impeller speed of from about 450 RPM to about 800 RPM. The cryomilling may be done for a duration of from about 4 hours to about 20 hours to obtain a cryomilled powder. The cryomilled powder may be consolidated to form the particulate reinforced NiAl-AlN composite alloy. The particulate reinforced alloy can further include a toughening alloy. The toughening alloy may include NiCrAlY, FeCrAY and FeAl.

29 Claims, 21 Drawing Sheets

| ALLOY | Ni5OAl | NiAl-AlN | NiAl-AlN+FeAl | NiAl-AlN+FeCrAlY | NiAl-AlN+NiCrAlY |
|---|---|---|---|---|---|
| 20 VOL% | 6 | 5 | 8 | 12 | 18 |
| 40 VOL% | | | 10 | 14 | 22 |

NIAL-BASE COMPOSITE CONTAINING HIGH VOLUME FRACTION OF ALN FOR ADVANCED ENGINES

ORIGIN OF THE INVENTION

The invention described herein was made by employees of the U.S. Government and a contractor employee and may be manufactured and used by or for the U.S. Government without the payment of any royalties thereon or therefor.

FIELD OF THE INVENTION

This invention relates to NiAl-based intermetallic composite in general and more particularly to dispersion strengthened NiAl-based composite alloys for use in very high temperature structural applications including advanced engine applications.

BACKGROUND OF THE INVENTION

There is great demand for structural materials that can withstand adverse environments at increasingly higher temperatures and stresses. The upper operating temperature of conventional heat resistant alloys is limited to the temperature at which second phase particles of the alloy are substantially dissolved in the alloy matrix or to the temperature at which the particles become severely coarsened. Above this limiting temperature the alloys no longer exhibit useful strength.

The high melting point, low density and excellent oxidation/corrosion resistance of binary NiAl make it an excellent candidate for high temperature structural purposes. Its poor mechanical properties at elevated temperature, however, indicate that use of the monolithic material is improbable. In U.S. Pat. No. 4,961,905 to Law et al., NiAl intermetallic materials are modified by adding amounts of an alloying material that render the NiAl structure susceptible to a martensitic transformation. The preferred alloying element is cobalt, which can double or triple the fracture toughness of NiAl materials while simultaneously increasing the room temperature yield strength. Another approach for improving the properties of NiAl is by incorporating continuous reinforcing fibers for increased strength and improved damage tolerance. Single crystal $Al_2O_3$ is the reinforcing fiber of choice because of its high modulus and strength, low density and chemical stability.

The mechanical properties of polycrystalline NiAl reinforced with 30 vol. % continuous single crystalline $Al_2O_3$ fibers were investigated and reported by Bowman, in "Influence of interfacial characteristics on the mechanical properties of continuous fiber reinforced NiAl composites," *Mat. Res. Soc. Symp. Proc.*, Vol. 273, 1992. Bowman reports the mechanical properties of a NiAl composite reinforced with either weakly or strongly bonded $Al_2O_3$ fibers. A strong interfacial bond between the $Al_2O_3$ and the NiAl is a requirement for oxidation resistance. However, the difference between the coefficients of thermal expansion for the $Al_2O_3$ fibers and for NiAl, together with the interfacial strong bond, contributes to severe crack formation in the composite due to thermally generated internal stress. In the powder-cloth ("P-C") process for composite production discussed in Bowman, alloy matrix material is processed into flexible cloth-like sheets by combining matrix powders with an organic polymer binder. The presence of the polymer binder inhibits fiber-matrix bonding, thereby increasing the matrix's resistance to cracking. However, in addition to low oxidation resistance afforded the material due to the weak bond, fiber distribution can be irregular and difficult to control with P-C processing. This problem is considered by Bowman et al., in "Unresolved technical barriers to the development of a structurally viable $Al_2O_3$/NiAl composite," *HITEMP*, NASA-CP-19117, 1993. Thus, efforts to increase the strength of NiAl by alloying and compositing with continuous $Al_2O_3$ fibers have shown only limited improvements in the properties required for high temperature structural applications.

Mechanical alloying and related processes produce alloy materials with novel microstructures which can be used in structural applications. Cryomilling is high energy milling at cryogenic temperatures. Depending on the material system being used, cryomilling can also be a reaction milling process as in the case of milling prealloyed NiAl in liquid nitrogen. As the NiAl is fractured in liquid nitrogen, it reacts with the nitrogen, forming AlN on the surface of the powders. If there is any oxygen present, the fracture surfaces react with oxygen to form $Al_2O_3$ on the powder particles. The net result of milling NiAl in liquid nitrogen is an arrangement of fine particles of AlN, NiAl and $Al_2O_3$ on NiAl powder particle surfaces. Consolidation of the cryomilled NiAl powder via hot extrusion or hot isostatic pressing produces particulate strengthened materials with relatively high volume fractions of AlN. U.S. Pat. No. 4,619,699, to Petkovic-Luton et al., describes a cryomilling process as a means to improve the mechanical properties of high temperature Fe- and Ni-based oxide dispersion strengthened alloys by control of their structure. Cryomilling of NiAl leads to the formation of a discontinuous AlN particle reinforced aluminide that shows good potential as a high creep strength, oxidation resistant material at elevated temperatures. Luton et al., in "Cryomilling of nano-phase dispersion strengthened aluminum," *Mat. Res. Soc. Symp. Proc.*, Vol. 132, 1989, speculate that the high creep strength at elevated temperatures is due to a threshold stress for superplastic flow in the fine grain alloy formed when Al(ON) particles generated during the milling inhibit the grain growth in the aluminum matrix.

In Whittenberger et al., "Preliminary investigation of a NiAl composite prepared by cryomilling," *J. Mat. Res.*, Vol 5, No. 2, Feb 1990, prealloyed Ni-51 (at. %) Al was cryomilled with $Y_2O_3$ to improve the high temperature strength resistance of the resultant alloy to form an NiAl -AlN composite alloy wherein the volume fraction of AlN within the NiAl matrix was estimated to be about 10%. Upon compression testing at 1200 and 1400 K, the creep strength was measured to be six times better than that of NiAl. NiAl-AlN composite alloys having volume fractions of up to 13% AlN were reported in Aiken et al., "Reproducibility of NiAl cryomilling," *Mech. All. for Struct. App.*, Proc. 2nd Int. Conf. Struct. Appl. Mech. All., Sept. 20–22 1993 and in Whittenberger et al. "1300 K Compressive Properties of a Reaction Milled NiAl-AlN Composite," *J. Mater. Res.*, Vol. 5, No. 12, Dec. 1990, pp. 2819–2827. Compression testing of the NiAl-AlN alloys at 1100 and 1300 K showed creep strengths superior to those of $\gamma'$ and oxide dispersion strengthened polycrystalline superalloys and results were considered to be very reproducible.

AlN formed from the reaction of nitrogen with Al during cryomilling has the deleterious effect of depleting Al from the NiAl matrix, thereby lowering the cyclic oxidation resistance of the NiAl base material. Thus, as the AlN volume content of the NiAl-AlN alloy (and related high temperature properties) goes up, the oxidation resistance of the alloy goes down. Efforts to correct this problem include adding about 0.5 wt. % $Y_2O_3$ to prealloyed NiAl powder prior to cryomilling. Lowell et al. in "Cyclic oxidation resistance of a reaction milled NiAl-AlN composite," *Mat. Res. Soc. Symp. Proc.*, Vol. 194, 1990, compare the cyclic oxidation resistance of a NiAl-AlN alloy material wherein $Y_2O_3$ was added during cryomilling of NiAl with 0.15 atom % Zr. This probably improves the oxide scale adherence, thereby minimizing the Al consumption during cyclic oxidation. The cyclic oxidation limit for the NiAl-AlN was found to be about 1473 K for times greater than 100 hours and 1573 K for times under 100 hours. Additionally, as the Al becomes depleted from the NiAl matrix, the thermal conductivity, an important property of aircraft engines, is also reduced. A further problem associated with Al depletion from the matrix of these alloys includes an increase in density of the material.

In general, a major obstacle for structural applications of NiAl-AlN base materials is its low temperature toughness. The B2-crystal structure of NiAl with limited slip systems is believed to be the cause of lack of low temperature toughness. Several attempts at raising the toughness by alloying additions to modify the crystal structure or opening up additional slip systems in NiAl have shown very limited success.

SUMMARY OF THE INVENTION

To solve the above and other problems, the present invention is directed to a particulate reinforced NiAl-AlN composite alloy comprised of a NiAl matrix having greater than about 13 volume percent, preferably at least 15 volume percent and most preferably 20 to about 50 volume percent particles of AlN within said matrix. In a preferred embodiment, the composite alloy has from about 30 to about 40 volume percent particles of AlN within said matrix. The particles preferably have a diameter from about 15 nanometers to about 50 nanometers.

The NiAl-AlN composite according to the present invention preferably has from about 37 atom % to about 56 atom % and preferably about 55 atom % Al in the NiAl matrix to increase oxidation resistance of the composite alloy. The composite can further comprise a toughening alloy selected from the group consisting of NiCrAlY, FeCrAlY and FeAl.

Particulate reinforced NiAl-AlN composite alloys in accordance with this invention may be prepared by cryomilling prealloyed NiAl in liquid nitrogen, for example, using grinding media having a diameter of from about 2 mm to about 6 mm at an impeller speed of from about 450 RPM to about 800 RPM for a duration of from about 4 hours to about 20 hours to obtain a cryomilled powder. The cryomilled powder is consolidated to form particulate reinforced NiAl-AlN composite alloy.

BRIEF DESCRIPTION OF THE DRAWINGS

FIGS. 3 show influence of cryomilling parameters on NiAl alloys.

FIGS. 4 further show the influence of grinding parameters on NiAl alloy.

FIGS. 6 are optical micrographs of fully consolidated NiAl-AlN.

FIGS. 7 show the influence of AlN content on properties of the cryomilled NiAl-AlN alloy.

FIGS. 8 are SEM fractographs of chevron notched bend NiAl-AlN specimen.

DESCRIPTION OF PREFERRED EMBODIMENTS

Figure 1:
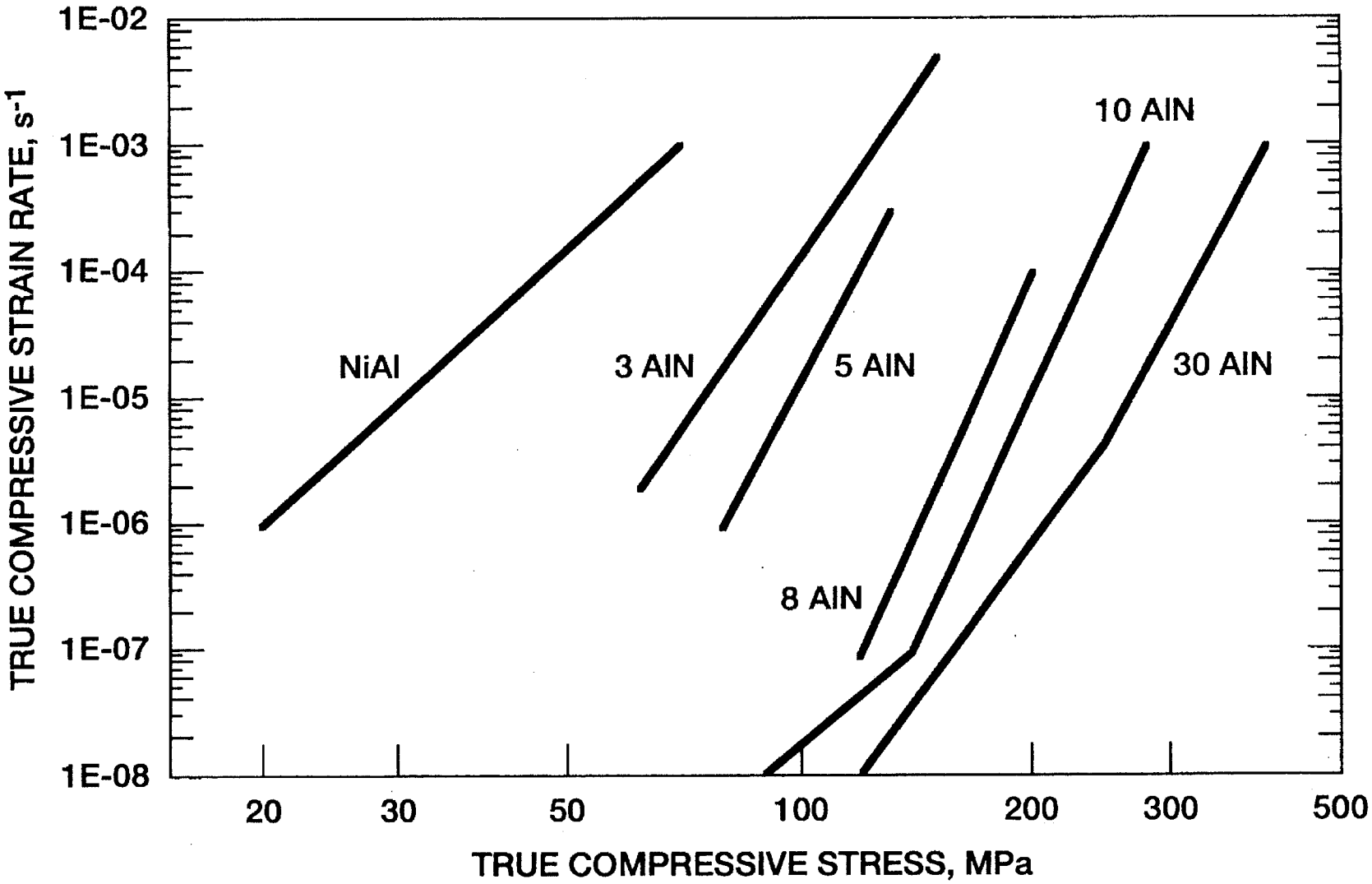
FIG. 1 shows the influence of AlN content on the compressive true stress strain rate behavior of an NiAl-AlN alloy at 1300 K.

The present inventors in "Microstructure/property relations in AlN and $Al_2O_3$ particulate strengthened NiAl," *Mat. Res. Soc. Symp. Proc., Vol.* 288, 1993, Hebsur et al. (hereby incorporated herein by reference) conclude that the attractive strength levels of the AlN containing NiAl are the direct result of the presence of the AlN particles within the NiAl matrix. Volume fractions of up to 30% AlN in the NiAl matrix of alloys are obtained by the present inventors, as they report in "Characteristics of an elevated temperature AlN particulate reinforced NiAi," *Structural Intermetallics*, Oct. 1993 (hereby incorporated herein by reference).

According to the present invention, particulate reinforced NiAl-AlN composite alloy having greater than 13 and up to about 50% AlN can be prepared by cryomilling prealloyed NiAl in liquid nitrogen using grinding media having a diameter about 2 mm to about 6 mm and preferably about 3 mm at an impeller speed of from about 450 RPM to preferably about 800 RPM for a duration of from about 4 to about 20 and preferably about 16 hours to obtain a cryomilled powder. The impeller shaft geometry can play an important role in the cryomilling operation. By keeping all cryomilling parameters the same except changing the impeller shaft arm configuration from straight to an inverse L shape, the nitrogen content and hence the volume fraction AlN in the cryomilled NiAl can be substantially increased. Thus, in a preferred embodiment the arm configuration of the impeller shaft is in an inverted "L" shape during cryomilling. Additionally, by using larger sized attritors in the cryomilling process, having 6 litres capacity stainless steel tanks instead of 1.4 litre tanks, high Al %-NiAl-AlN composites may be obtained by cryomilling NiAl powder for fewer hours, e.g., for 8 hours as opposed to 16 hours.

The cryomilled powder is consolidated to form the particulate reinforced NiAl-AlN composite alloy. The consolidation of cryomilled powder by hot pressing followed by hot isostatic pressing results in a fully dense NiAl based composite alloy comprising a NiAl matrix having greater than about 13 volume percent to about 50 volume percent and preferably from about 30 to about 40 volume percent fine particles of AlN within the matrix. The particles of AlN preferably have a diameter from about 15 nanometers to about 50 nanometers.

The NiAl-AlN composite according to the present invention has a room temperature compressive strength of from about 1800 to about 2400 MPa and preferably about 2200 MPa and a compressive creep strength of from about 200 MPa to about 300 MPa and preferably about 260 MPa under 1300 K and strain rate of $10^{-6}$ S conditions. The composite has a room temperature fracture toughness of from about 45 MPa√m to about 6 MPa√m and preferably about 5 MPa√m under 0.01 1 mm/min. conditions.

Since most applications for these alloys require very light materials, a higher Al content is desirable. Moreover, to increase the specific strength (strength/density) of the materials, the lowest density materials are needed. Thus, with the advent of higher volume % AlN, NiAl-AlN composite alloys, methods and materials for improving the cyclic oxidation resistance, specific strength and thermal conductivity of the alloys are needed.

In an embodiment of the present invention, the NiAl matrix has from about 37% to about 56 atom % and preferably about 55 atom % aluminum. In embodiments where there is a stoichiometric excess of Al, e.g., atom % aluminum is greater than 50%, the NiAl-AlN composite has an specific weight gain at 1000 K cycles and 1473 K of from about 5 mg/cm$^2$ to about 2 mg/cm$^2$ and preferably about 3 mg/cm$^2$. The NiAl-AlN composite having a stoichiometric excess of aluminum has a thermal conductivity of from about 43 W/m·k to about 30 W/m·k and preferably about 35 W/m·k.

In a preferred embodiment, the particulate reinforced NiAl-AlN composite alloy (e.g., NiAl-30AlN) is prepared wherein the prealloyed NiAl contains from about 2 to about 6 and preferably about 4 atom % stoichiometric excess of Al.

Figure 2:
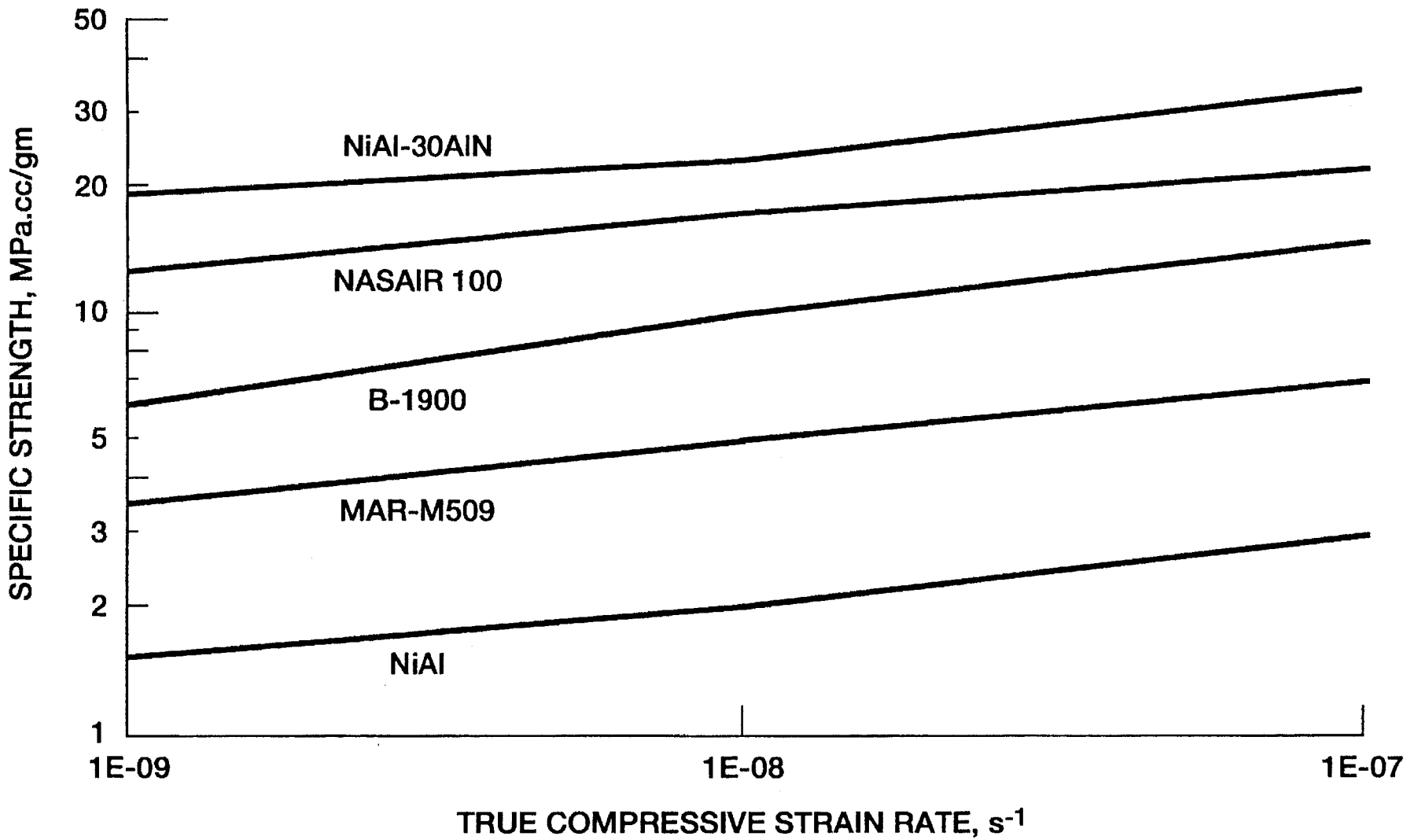
FIG. 2 shows a comparison of 1300° K. specific group strength of NiAl-AlN between high temperature materials NiAl-30 AlN, NASAIR 100 (Nickel-base single crystal superalloy (Garret Engine Co.)), B-1900 (Nickel base superalloy (International Nickel Co.)), Mar-M 501 (Cobalt base superalloy (Marten-Mariette)), and NiAl.

The NiAl-30 AlN composite in accordance with the present invention exhibits highest compression yield strength with all temperatures between 300 and 1300 K as comparable with other compositions of NiAl-AlN composite. The NiAl-30 AlN specimen tested under compressive creep loading between 1300 and 1500 K also exhibits highest creep resistance as shown in FIG. 1 with very little surface oxidation, indicating also its superior elevated temperature oxidation resistance. FIG. 1 also shows that in a high stress exponent regime the strength of the particulate is proportional to the square root of the AlN content and that in the low stress exponent regime, the influence of AlN content on strength appears to be less dramatic. The specific creep strength of this material at 1300 K is superior to the first generation Ni based single crystal superalloy as shown in FIG. 2. The improvements in elevated temperature creep strength and oxidation resistance are achieved without sacrificing room temperature fracture toughness of the NiAl base material.

In accordance with the present invention, low temperature toughness of NiAl-AlN can be improved by ductile phase reinforcement. The dominant contribution to toughening comes from traction produced by the ductile ligaments bridging the crack surfaces, thus shielding the crack tip. Toughening by this mechanism can be enhanced by increasing the size, volume fraction, the work of rupture, strength and strain hardening exponent of the ductile phase.

According to the present invention, low temperature toughness of particulate reinforced NiAl-AlN composites can be especially improved by cryomilling in an attritor with an impeller having an arm, prealloyed NiAl and an alloy selected from the group consisting of prealloyed NiCrAlY, FeCrAlY and FeAl in liquid nitrogen. The cryomilling conditions should be such as to obtain a cryomilled powder which forms upon consolidation a particulate reinforced NiAl-AlN composite alloy comprising a NiAl matrix having greater than about 13 volume percent particles of AlN within said matrix. In the method for improving the low temperature toughness the volume percent of the NiAl is from about 55% to about 85% and the volume percent of the alloy is from about 45% to about 15%. When the alloy cryomilled with NiAl is NiCrAlY, the low temperature toughness of the NiAl-AlN composite is from about 18 MPa to about 22 MPa when the alloy is FeCrAlY, the low temperature toughness of the NiAl-AlN composite is from about 12 MPa to about 16 MPa and when it is FeAl, the low temperature toughness of the NiAl-AlN composite is from about 8 MPa to about 10 MPa√m.

NiCrAlY (Ni-wt. % 16 Cr-6Al -0.3Y) and FeCrAlY (Fe-wt %24Cr-4Al-0.3Y) with −200 mesh size gas atomized powders (Alloy Metals, Inc.) have excellent toughness, ductility and high temperature oxidation resistance. Even Fe-40Al is more ductile than NiAl and forms AlN readily during cryomilling. The FeAl powder is produced by induction melting followed by melt spinning.

The following non-limiting examples are presented to more fully describe the invention. It should be understood that these examples in no way limit the scope of this invention, but rather, are presented for illustrative purposes.

EXAMPLES

Methods and Materials

About 1000 grams of high purity (99.99%) elemental nickel pellets (660 grams) and 340 grams of aluminum pellets (AESAR Johnson Matthey Inc.) are induction melted in $Al_2O_3$-$SiO_2$ crucibles (Taycor). The furnace is evacuated twice to $10^{-3}$ Pa and back filled with high purity argon prior to melting. The molten metal is poured into 25.5 mm diameter×250 mm long copper molds. The castings produced by this technique have some shrinkage porosity and larger grain size with small amount of segregation.

Rapid solidification of as cast Ni-53Al is carried out to obtain a fine grained and homogenous material. Rapidly solidified NiAl is achieved by melt spinning in a free jet chill block melt spinning facility (CBMS). About 200 grams of the prealloyed Ni-53Al casting is used for each melt spinning run. In order to remove surface oxide scale, the charge is polished on 600 grit paper and then ultrasonically cleaned in acetone before melting in 37 mm O.D. high purity/high density alumina crucibles (Coors) with a 1 mm diameter nozzle in the bottom by means of induction heating. The crucible and wheel assembly are enclosed in a chamber evacuated to $10^{-5}$ Pa and then back filled with high purity argon. After an initial period of slow heating to 1275 K, the heating rate is increased drastically to reach a desired temperature quickly in order to minimize the contact time of hot metal with a crucible wall. The temperature of the melt is monitored using an infrared optical pyrometer which is viewed through a port located in the chamber. When the desired temperature, which is usually 350 K above the liquidus temperature, is reached, pressurized argon gas is introduced at the top of the crucible, causing the liquid to impinge onto the rotating wheel. A copper wheel of 300 mm diameter and a crucible-wheel gap of 19 mm are used. All melt spin runs are made with a wheel speed of 20 meter per second and an ejection pressure of 26.6 MpA to obtain a 3 mm wide rapidly solidified ribbon. The ribbon segments vary from a few millimeters to over 100 mm.

The melt spin ribbons are brittle and exhibit fine grain homogenous microstructure. The melt spun ribbon is crushed and ground to −100 mesh size powder using 6 mm diameter stainless steel balls in a planetary mill for about 1 hour under argon gas. About 500 grams of this powder is used for cryomilling.

Cryomilling is carried out in a modified Union Process 01-HD attritor equipped with a 1.4 litre stainless steel chamber. Approximately 4000 grams of 3 mm diameter 440 stainless steel grinding media (Abbot Ball Company) and 500 grams of prealloyed NiAl powder are placed in the tank, which is then filled with liquid nitrogen. Once the temperature within the tank is stabilized at 77 K, the mill is started and the straight arm stainless steel impeller is quickly brought to the operating speed of 800 rpm. This milling action is continued for 16 hours. During the entire milling period the liquid level in the tank is constantly maintained by a thermocouple sensor. Except for loading of ball/powder mixture, the entire operation is conducted in a well controlled argon atmosphere with small positive pressure to minimize the condensation effects while a continuous liquid nitrogen flow is maintained in the cooling jacket tank to minimize the temperature rise during milling.

Following the 16 hour milling run, the tank is transferred to a dry box and the liquid nitrogen is allowed to boil off. After warming to room temperature, the cryomilled powder is separated from the grinding balls by sieving. The composition of prealloyed NiAl is established as Ni-53 atom % Al. Thus, for subsequent cryomilling experiments, gas atomized Ni-53 atom % Al powder (Homogenous Metals, Inc.) is used.

Milled powders obtained from all Examples are consolidated to form alloys by hot pressing at 1373 K/35 MPa for 3 hours under argon atmosphere to produce 60 mm long×40 mm wide×12.5 mm compacts with about 90% density. The hot pressed compacts are sealed in titanium killed steel cans and hot isostatically pressed at 1373 K/20 MPa for 3 hours to obtain fully dense (nearly 100% density) materials.

EXAMPLE 2

About 500 gm of prealloyed Ni-50 atom % (instead of Ni-53 atom %) Al melt spun alloy is made in accordance with the procedure above. The melt spun alloy is cryomilled in a modified attritor mill (Union Process model 01-HD) using 4,000 grams of grinding media consisting of 6 mm diameter, 440 stainless steel balls at an impeller speed of approximately 450 rpm to produce milled powder. During milling, liquid nitrogen is introduced into the grinding tank and the level of the nitrogen is automatically controlled by a thermocouple sensor. The outer jacket of the tank is cooled by a continuous flow of liquid nitrogen. Milling duration is varied between 2 and 24 hours and the impeller speed is varied between 450 to 800 rpm.

EXAMPLE 2

The same procedure as in Example 1 is repeated except that 0.5 wt. % of $Y_2O_3$ is added to the attritor during the cryomilling, which is conducted for 16 hours at an impeller speed of 800 rpm.

EXAMPLE 3

The same procedure as in Example 1 is repeated except that the grinding media is 3 mm stainless steel balls and the duration of the cryomilling is 16 hours at an impeller speed of 800 rpm.

EXAMPLE 4

Cryomilling of prealloyed meltspun ribbon of Ni-55 atom percent Al is carried out using 3 mm diameter, 440 stainless steel grinding media and 800 rpm empowered speed. The grinding media to powder ratio is approximately 8 to 1. After milling for 16 hours, the powder is transferred to a glove box for warming to room temperature under dry argon. Chemical analysis of the melt spun ribbon and cryomilled powder are given in Table 1. The consolidation of cryomilled powder is carried out in two steps of hot pressing at 1454 K/31 MPa/2 hours followed by hot isostatic pressing at 1454 K/276 MPa/2 hours in a steel can.

TABLE 1

CHEMICAL COMPOSITION OF MELTSPUN AND CRYOMILLED Ni55Al

| | ELEMENTS WT. % | | | | MATRIX COMP. Al | 2nd Phase vol. % | |
|---|---|---|---|---|---|---|---|
| MATERIAL | Ni | Al | N | O | AT % | AlN | $Al_2O_3$ |
| Meltspun Ni55Al | 63.2 | 36.7 | — | .007 | 54.8 | — | — |
| Cryomilled Powder | 60.0 | 32.7 | 6.6 | .518 | 49.4 | 32.1 | 1.4 |
| HP + HIP NiAl-30AlN | 60.6 | 31.6 | 6.6 | .52 | 48.2 | 32.1 | 1.4 |

EXAMPLE 5

Several cryomilling runs are carried out, each using 500 grams of prealloyed powder mixture containing 1) 80 vol. % homogenous metal powder of Ni53Al and 20 vol. % FeCrAlY (387 gram NiAl+113 grams FeCrAlY); 2) 60 vol. % homogenous metals batch of Ni-53Al and about 40 vol. % of FeCrAlY (20 gms of NiAl+220 gms FeCrAlY); 3) 80 vol. % Ni-53Al and 20% of NiCrAlY (375 gms Ni53Al+125 gms NiCrAlY); 4) 60 vol. % Ni53Al and 40 vol. % NiCrAlY (264 gms Ni53Al+236 gms NiCrAlY); 5) about 80 vol. % Ni53Al and 20 vol. % FeAl (400 gms Ni53Al+100 gms FeAl); and 6) about 60 vol. % NiAl and 40 vol. % FeAl (300 gm Ni53Al+200 gms FeAl). Prior to cryomilling, each batch of powder mixture is mixed in a stainless steel jar and blended in a jar mill for about 8 hours. The blended powder is cryomilled in an 01-HD attritor using an L-shaped arm following the procedure described above. The cryomilled powders are hot pressed at 1373 K/35 MPa/3 hours under argon atmosphere to produce 60 mm long×40 mm wide by 12.5 mm compacts with about 90% density. These hot pressed compacts are sealed in titanium killed steel cans and hot isostatically pressed (HIP) at 1373 K/280 MPa for 3 hours to obtain fully dense (nearly 100% dense) materials. From these dense materials, chevron notched bend specimens for fracture toughness and 4 mm diameter×8 mm long cylindrical specimens for compressive strength measurements are obtained by electro-discharge-machining.

Figure 3A:
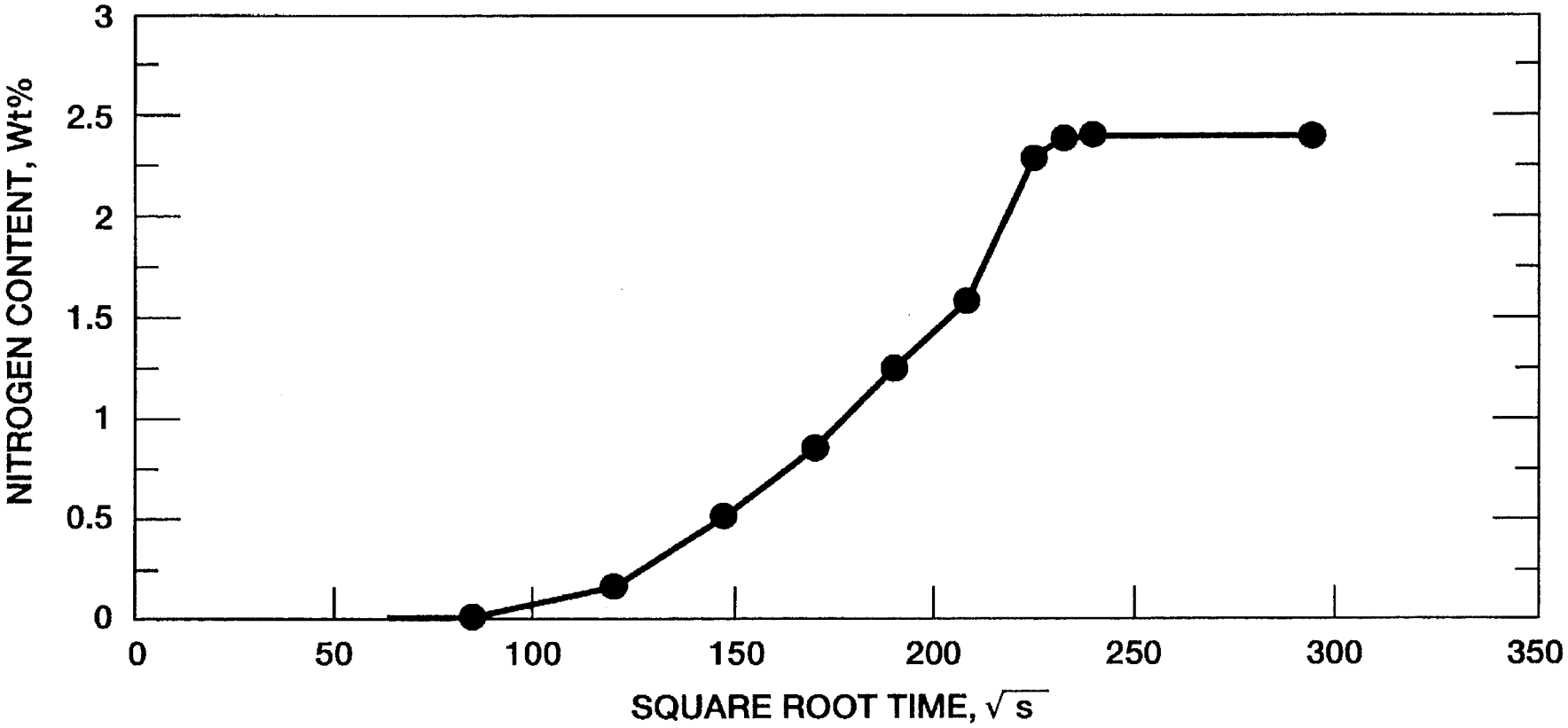
FIG. 3A shows the influence of cryomilling time on nitrogen content of an NiAl alloy.
Figure 3B:
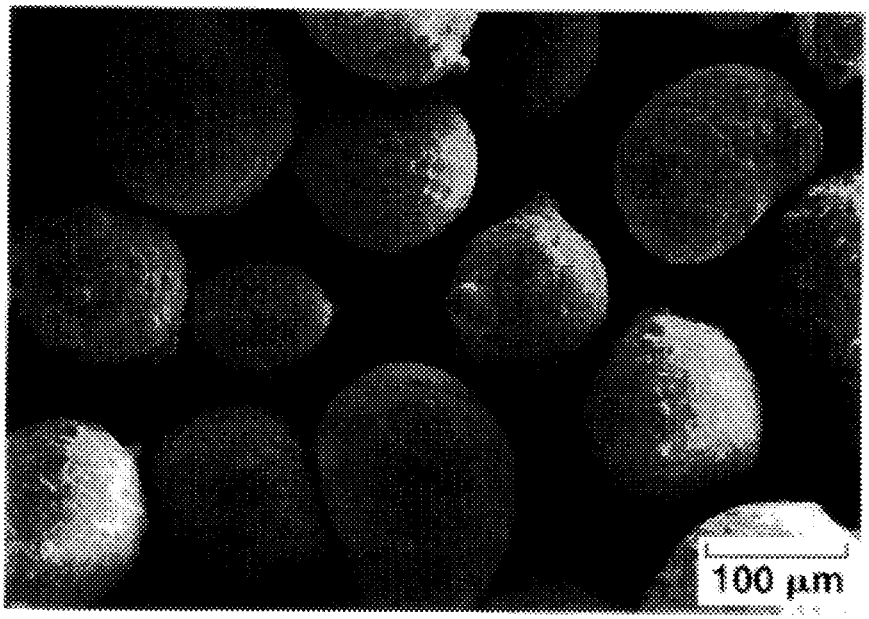
FIGS. 3B–3E are micrographs of cryomilled NiAl powder particles illustrating the influence of milling time on particle morphology.
Figure 3C:
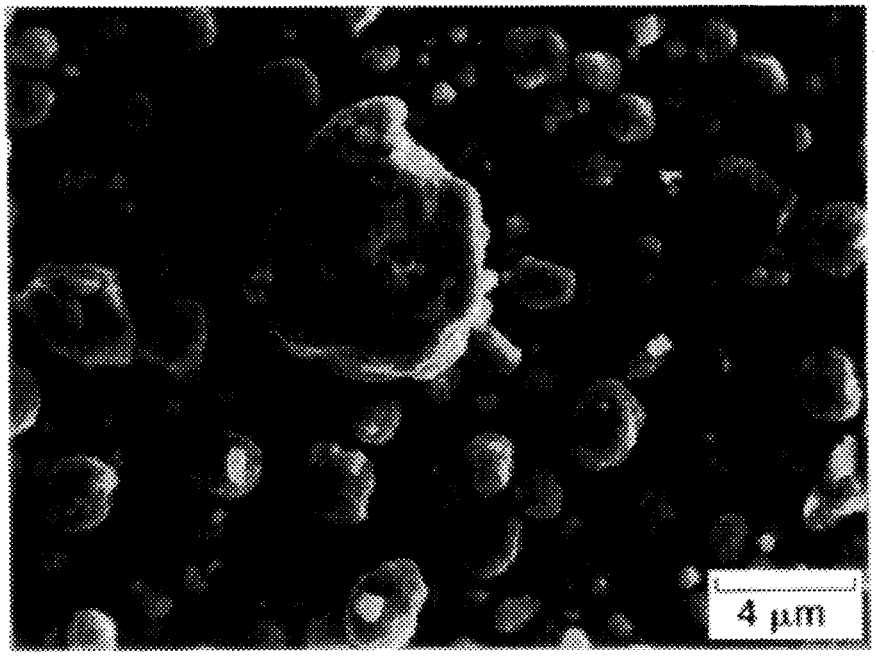
Figure 3D:
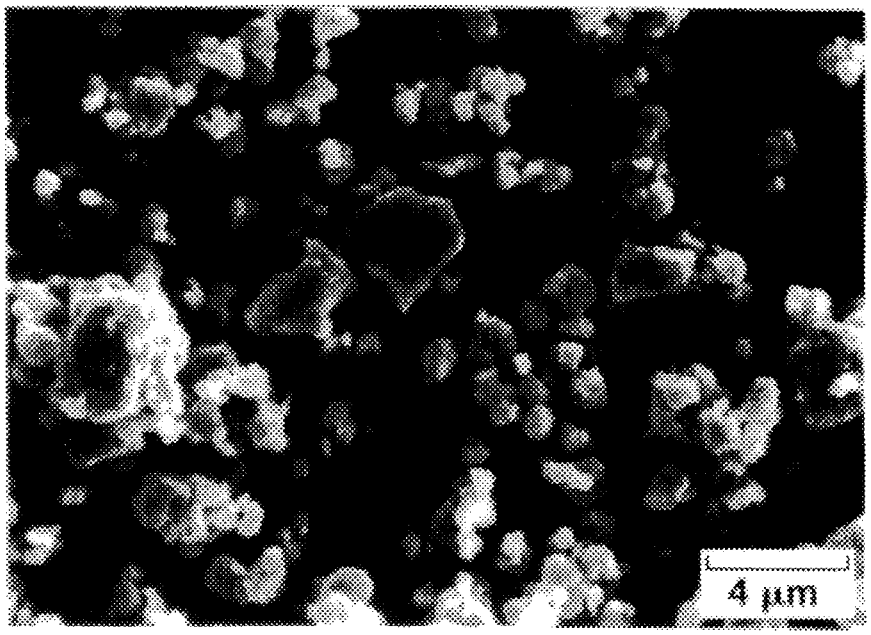
Figure 3E:
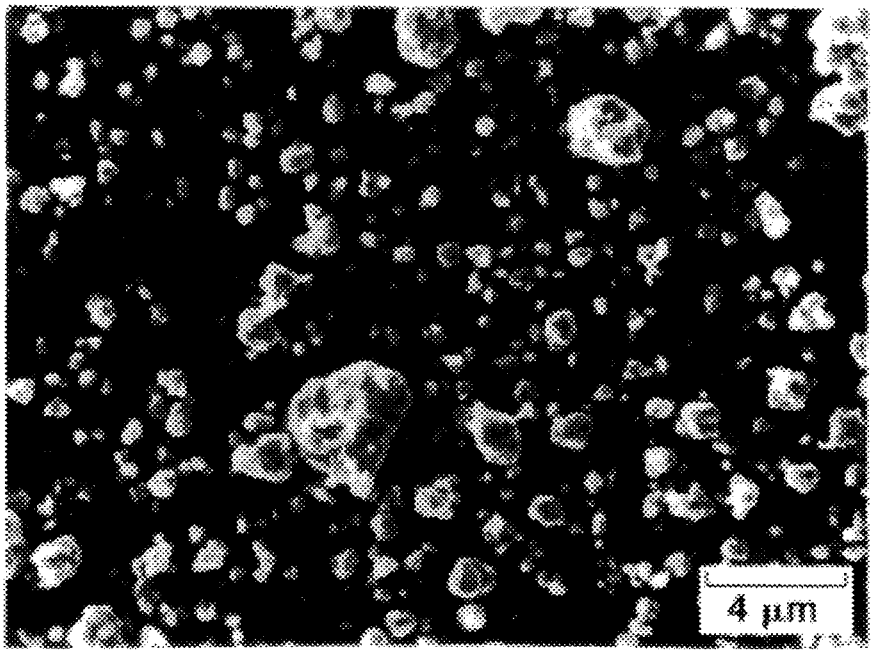

FIG. 3A shows the influence of milling time on nitrogen content of NiAl alloy during cryomilling. As shown in FIG. 3A, there is little nitrogen incorporated into the alloy during the first four hours of milling, followed by a steep increase in nitrogen content of the alloy up to 16 hours of milling. Continued milling beyond 16 hours does not appear to increase the nitrogen content any further. Additionally, the size of the milled powder particles decreases with increased milling time as shown in FIGS. 3B–E (38, 0 hr; 3C, 4 hr; 3D, 8 hr; 3E, 16 hr) and particle size distribution indicates a higher volume fraction of finer particles with increased milling time to 16 hours.

Figure 3F:
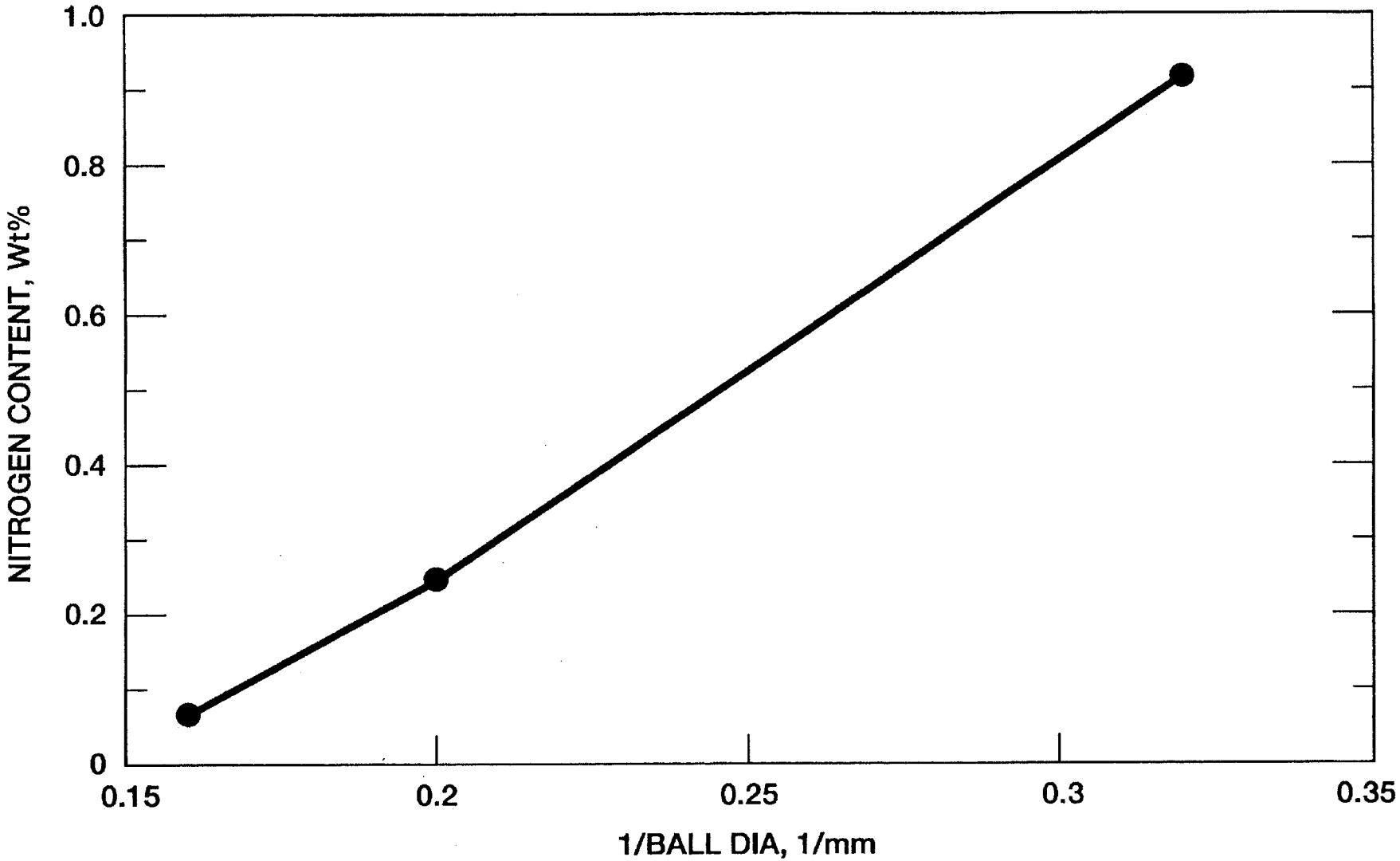
FIG. 3F shows the influence of size of grinding media on nitrogen pickup during cryomilling of NiAl.
Figure 4A:
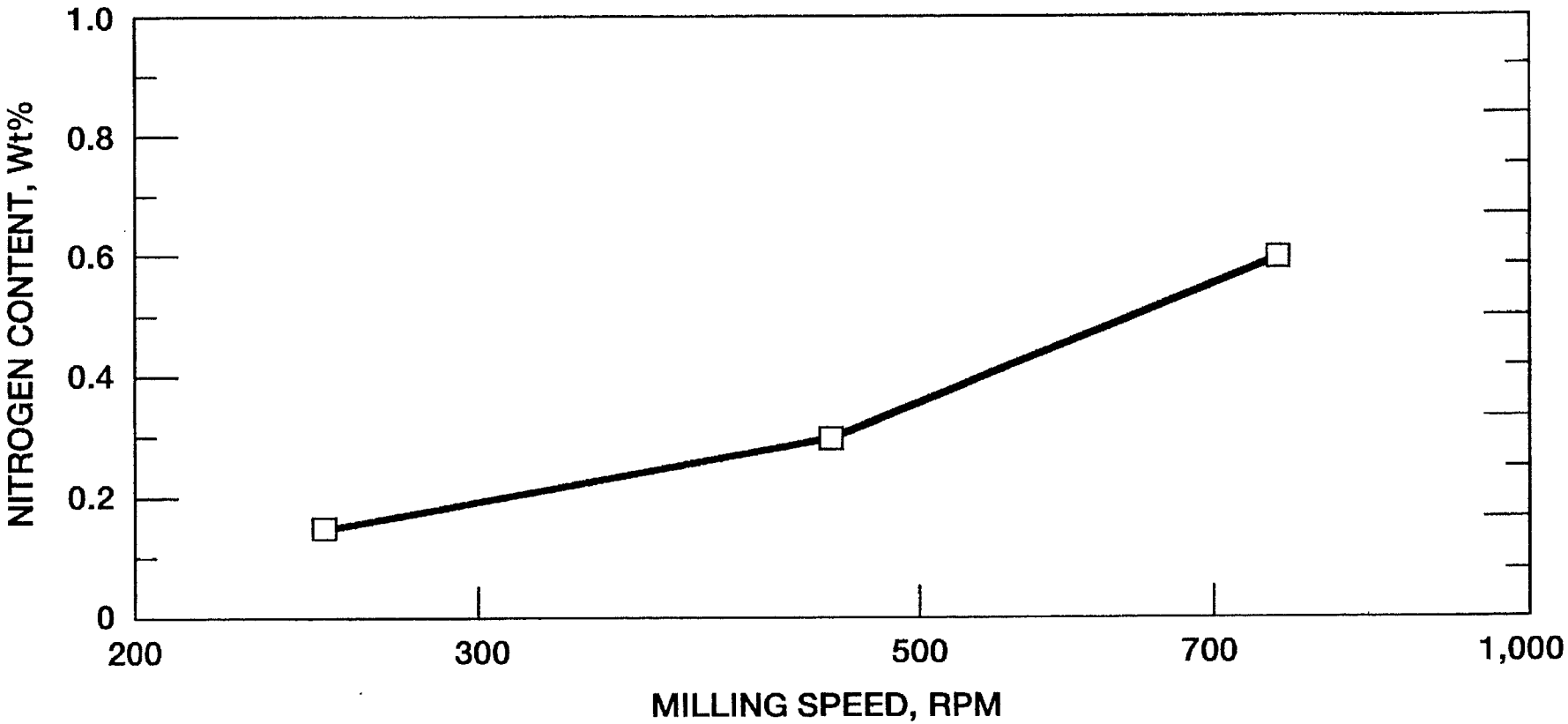
FIG. 4A shows the influence of milling speed on nitrogen pickup during cryomilling of NiAl and FIG. 4B shows the relationship between size of particles of NiAl and percentage of nitrogen pickup distribution in cryomilled NiAl.
Figure 4B:
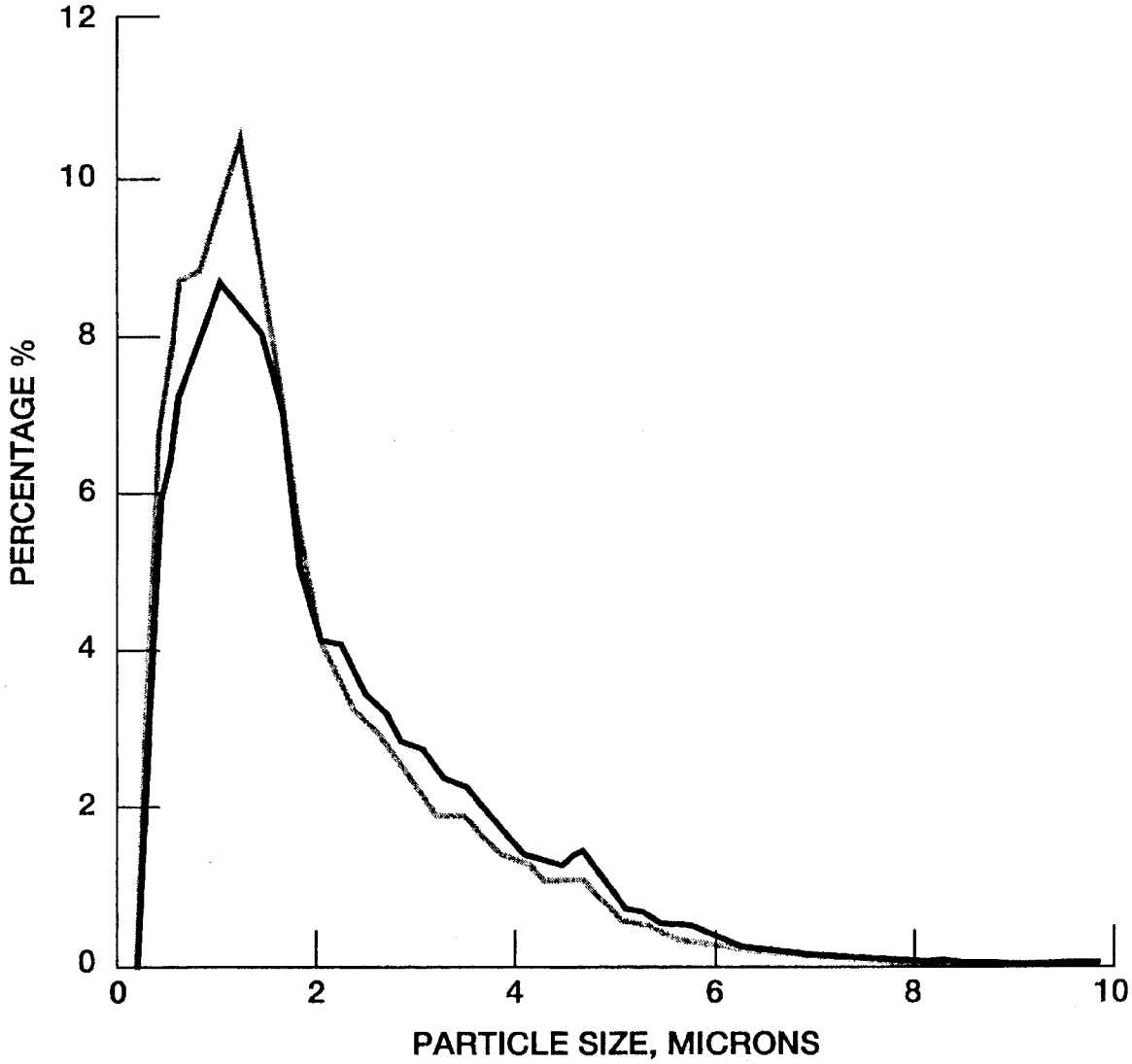

It appears that nitrogen incorporated into the alloy increases with increase in volume fraction of finer particles with larger surface area. Increasing the impeller rotation speed from 450 rpm to 800 rpm increases the nitrogen content as shown in FIG. 4A. Additionally, a comparison of the powders obtained in Example 1 with those obtained in Example 3 shows that the nitrogen content increases dramatically when smaller diameter (3 mm instead of 6 mm) grinding media is used in the cryomilling. The results of such a comparison is shown in FIG. 3F. The particle source distribution plot as shown in FIG. 4B indicates more efficient grinding with small diameter balls (grinding media) and hence higher nitrogen incorporation into the alloy. X-ray diffraction studies of cryomilled powder obtained in accordance with the Examples do not detect a ceramic phase.

Figure 5:
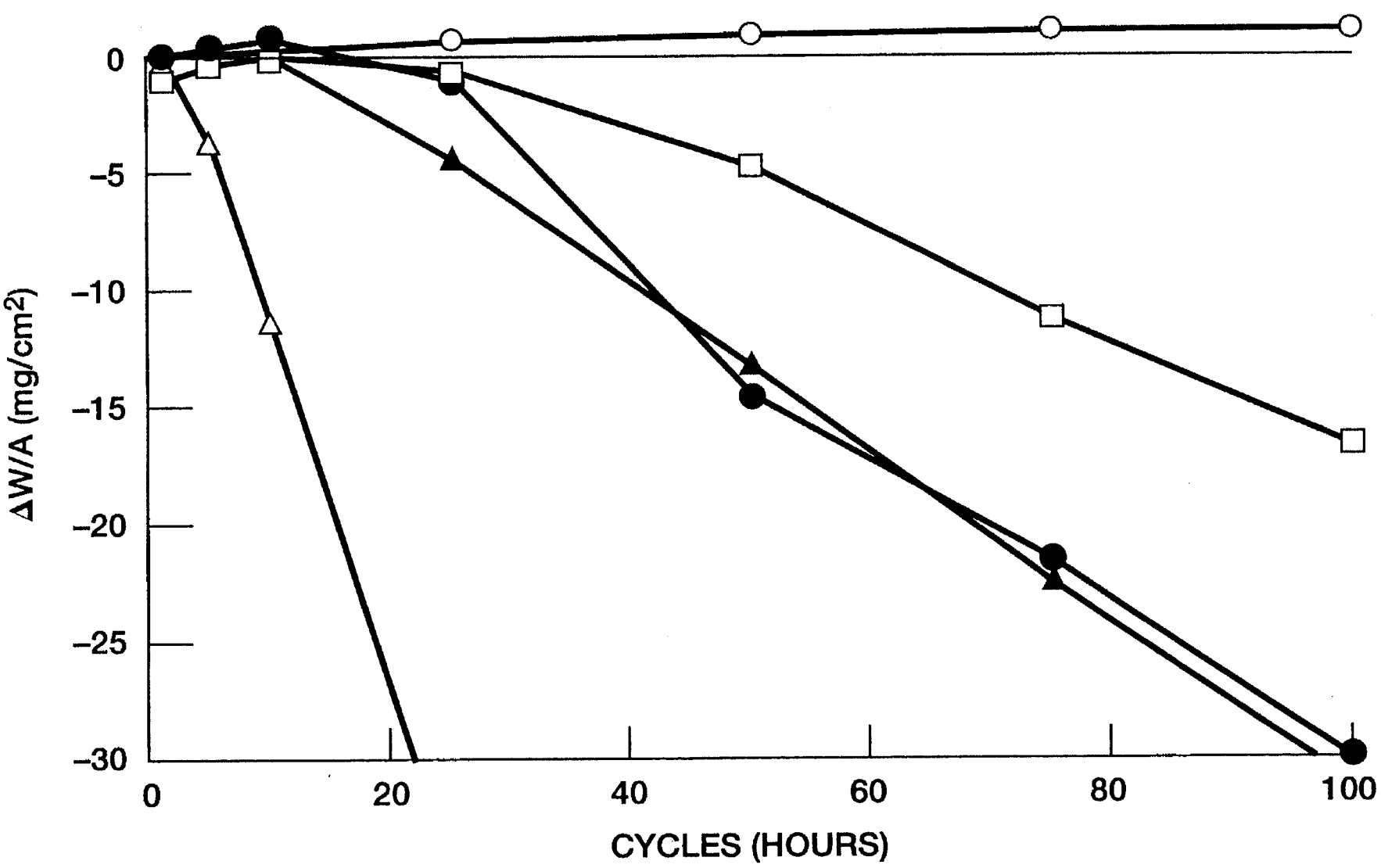
FIG. 5 shows a comparison of the cyclic oxidation of various NiAl-AlN alloys.

Cyclic oxidation tests are carried out at 1573 K on the composite obtained in Example 5. Each cycle consists of 1 hour in the furnace followed by 0.33 hour cooling in ambient. FIG. 5 shows specific weight change data for various compositions of NiAl based material as a function of the number of cycles. O, standard; •, 30 AlN; ▲, $Y_2O_3$; Δ, no $Y_2O_3$ and □, 10 AlN (High Al). These data demonstrate that the oxidation resistance of NiAl-30 AlN is comparable to NiAl-10 AlN with $Y_2O_3$ and superior to NiAl-10 AlN without $Y_2O_3$ addition. High aluminum content in NiAl improves long time cyclic oxidation behavior by adding about 2 to 3 atom percent aluminum during alloying. The cryomilled Ni-53 atom percent alloy exhibits improved oxidation resistance as compared to cryomilled Ni-50 atom percent alloy as seen in FIG. 5.

From the consolidated material, cylindrical compression specimens of 4 mm diameter×8 mm long, ASTM standard chevron notched four point bend bars and oxidation coupons of 16 mm diameter×2 mm thick are machined by electrodischarge machining followed by grinding.

Figure 6A:
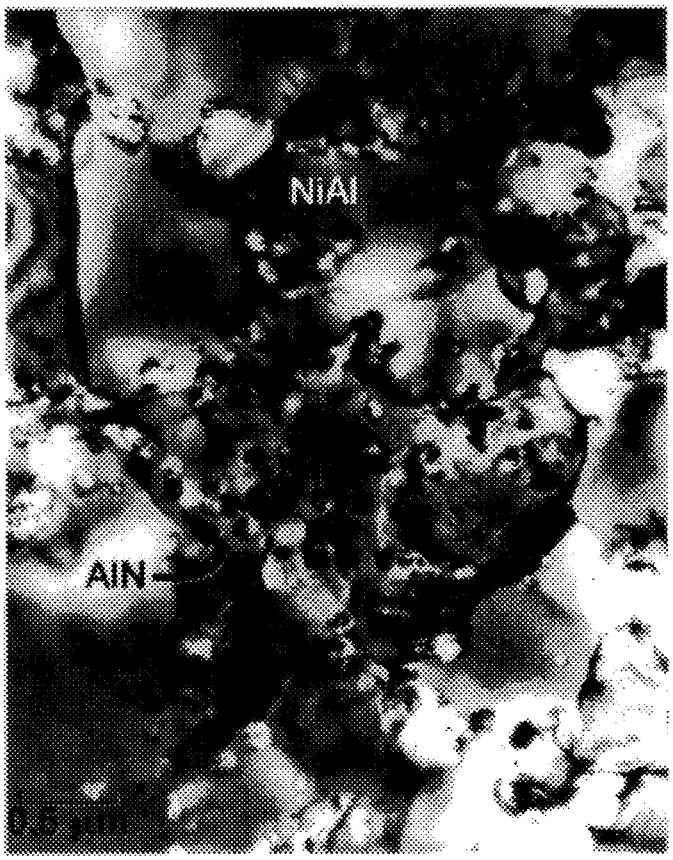
FIG. 6A is a micrograph of NiAl-4AlN and FIG. 6B is a micrograph of NiAl-30AlN.
Figure 6B:
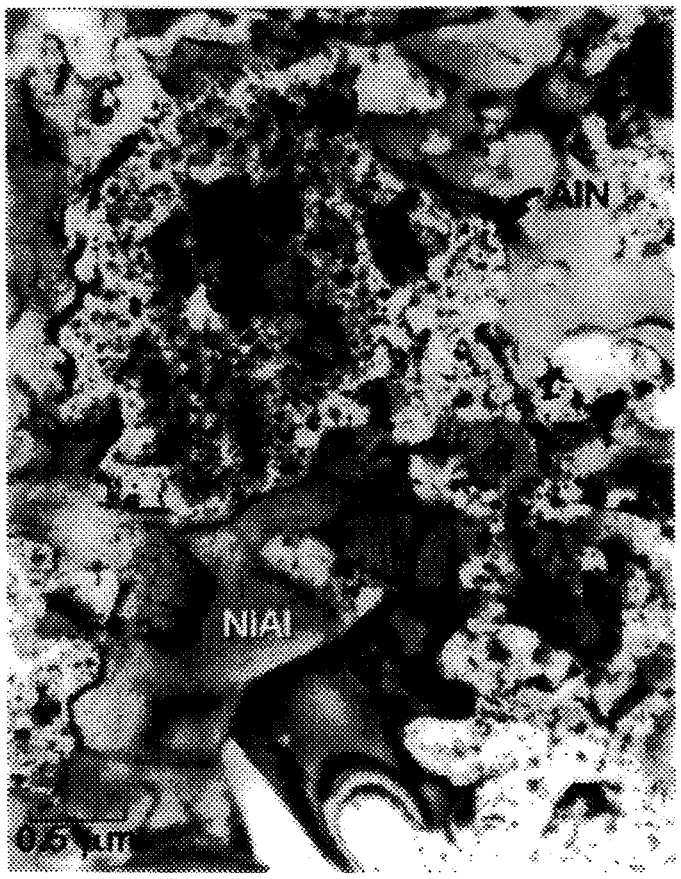

Upon consolidation, x-ray scans indicate significant amounts of this phase on the relative intensity ratio followed the trend of the lower volume fracture material. Optical micrographs of consolidated NiAl-30 AlN composite shown in FIG. 6B show a fine grain microstructure with a dark mantle of dispersed AlN outlining particle free regions. For comparison the microstructure of NiAl-4 AlN is included in FIG. 6A. The large grain structure in both materials represents unprocessed NiAl caught in dead zones of the attritor.

Figure 7A:
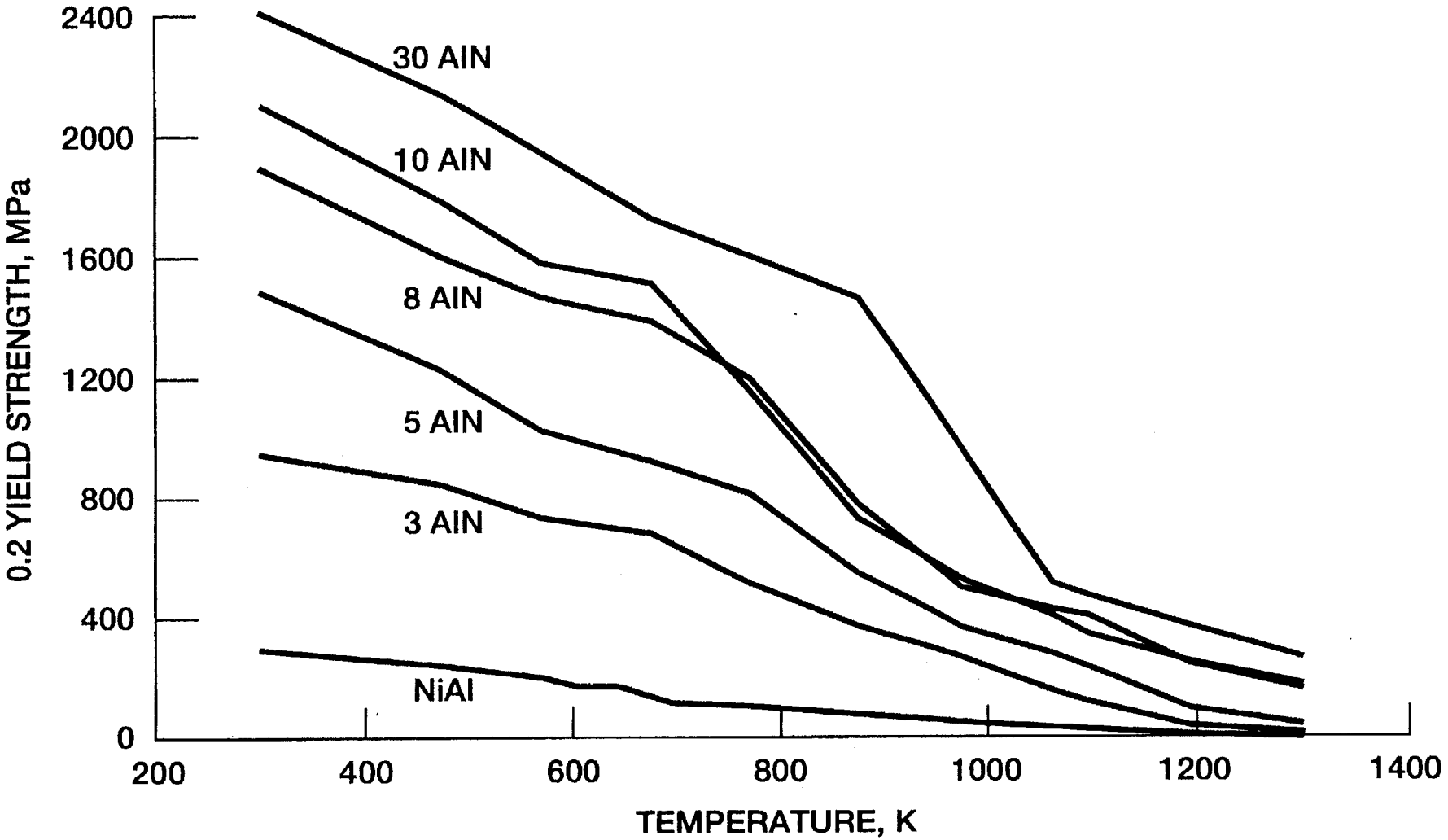
FIG. 7A shows the influence of AlN content on compressive yield strength at a strain rate of 0. 0001/sec.
Figure 7B:
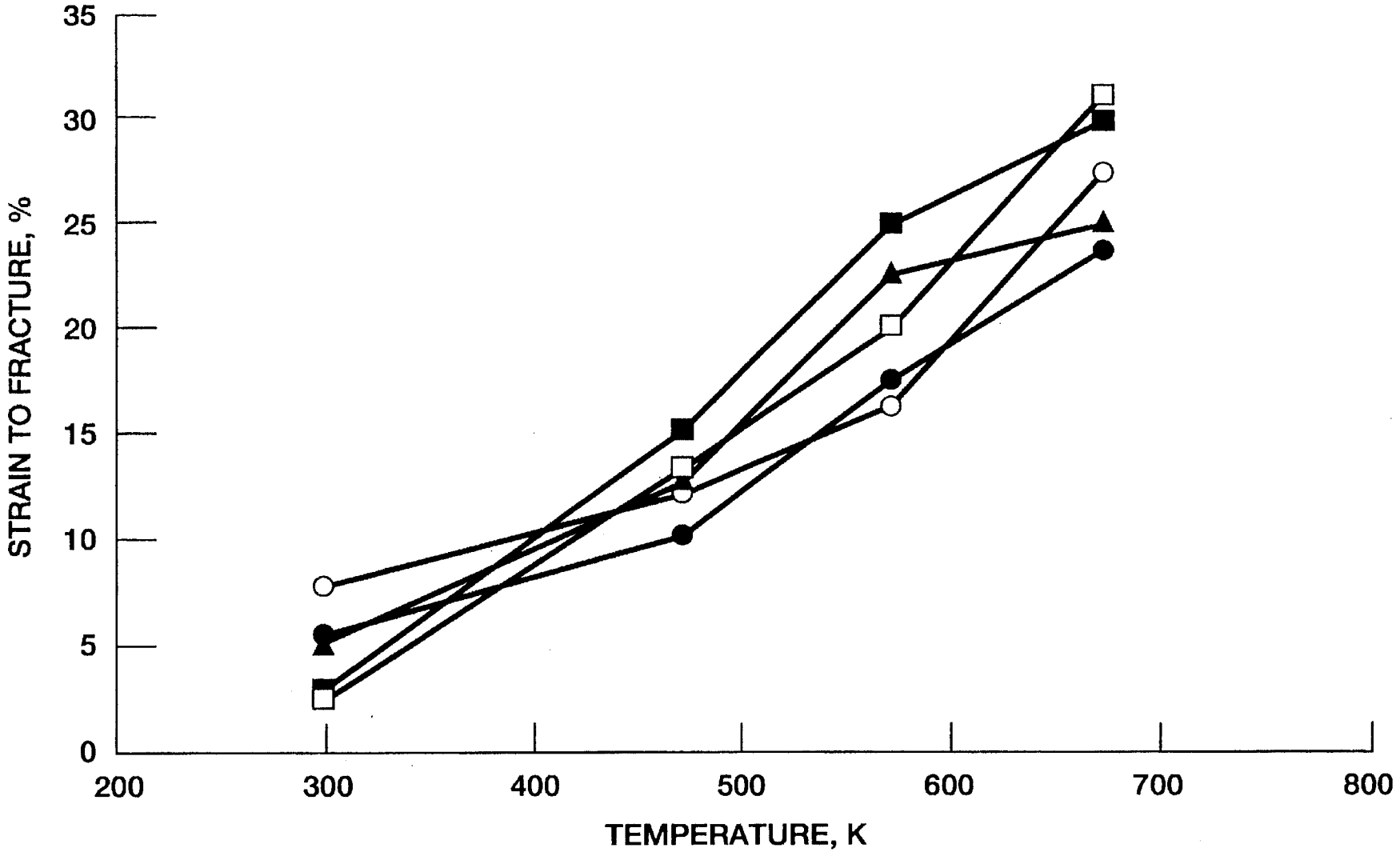
FIG. 7B shows the influence of AlN content on compressive strain to fracture.
Figure 7C:
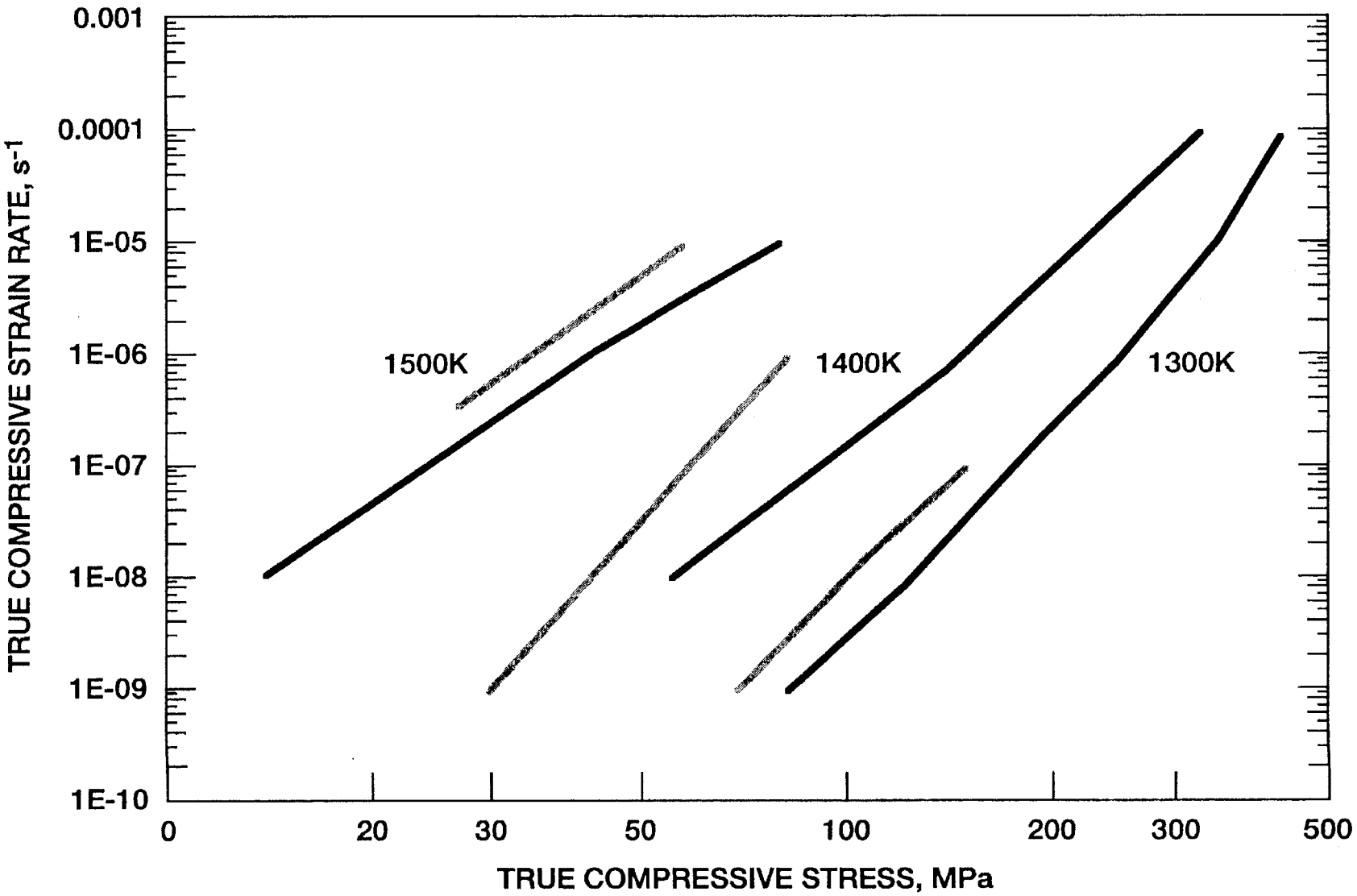
FIG. 7C shows the influence of AlN content on flow stress-strain rate behavior between 1300° and 1500° K.

Compression tests are conducted on a universal test machine between 300 K and 1300 K in air at a constant cross head speed of 0.5 mm/s. FIG. 7A illustrates an increase in compressive yield strength with increasing volume fraction of AlN and NiAl at temperatures between 300 and 1300 K. The compressive strength to fracture between 300 and 700 K (below DBTT) did not show any clear trend as a function of AlN content. See FIG. 7B. Compression test are also conducted in air between 1200 and 1500 K under constant cross head speeds ranging from $2.12\times10^{-4}$ to $8.47\times10^{-7}$ mm/s to approximately 8 percent strain in order to determine elevated temperature creep properties. Some constant low compressive creep tests are also conducted to determine the long term strength of the NiAl-30 AlN. The 1200 to 1500 K stress strain rate results for NiAl-AlN are shown in FIG. 7C. The creep strength of the composite is sensitive to temperature and the flow stress at a given strain rate decreases nearly by a factor of 2 for every 100 K increase in temperature. Although the metallography of long time creep tested specimens has not been carried out, contrary to the earlier observation of NiAl-10 AlN specimens which underwent extensive oxidation at 1500 K, the NiAl-30AlN specimen showed very little oxidation.

Figure 7D:
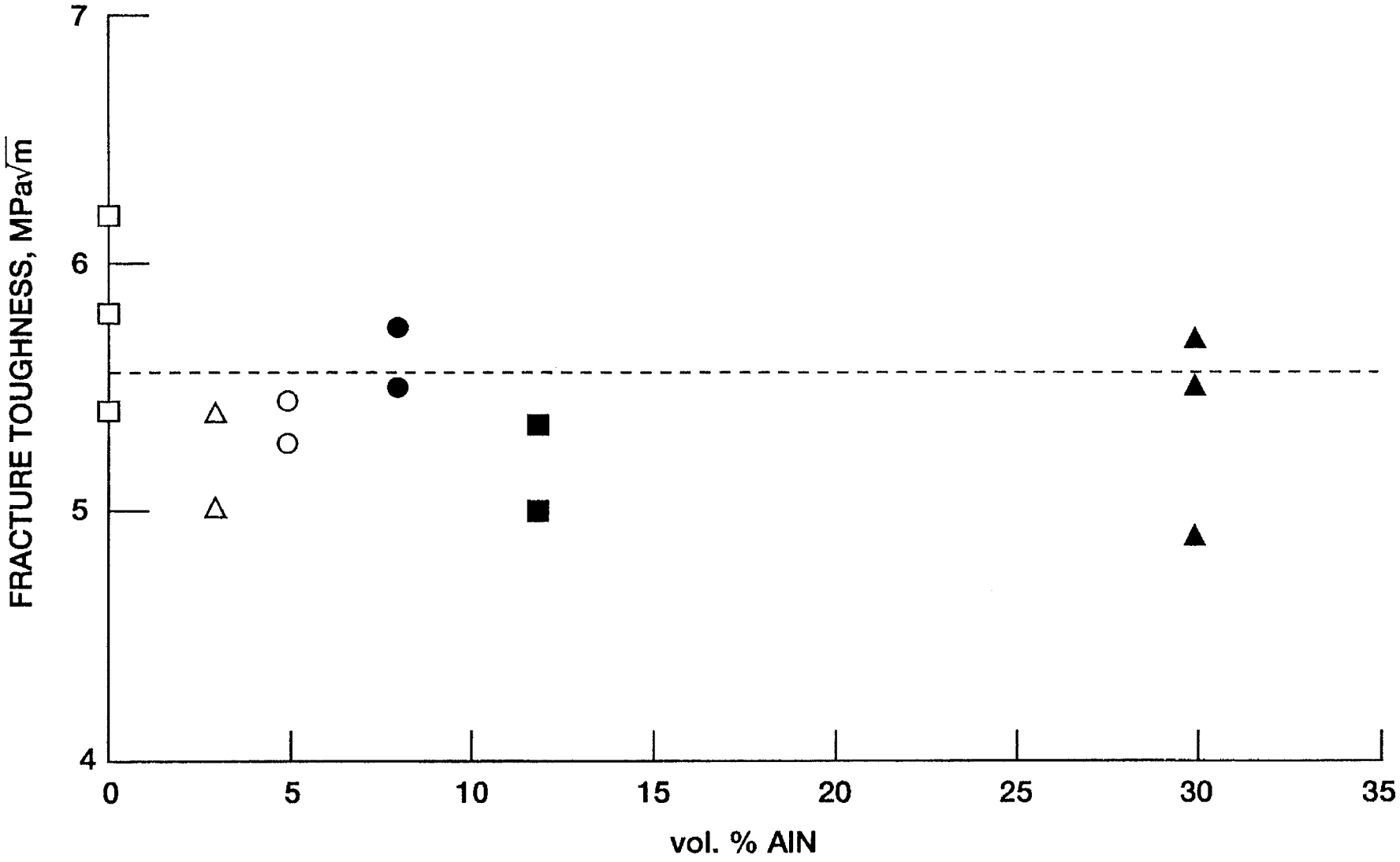
FIG. 7D shows the influence of AlN content on room temperature fracture toughness of cryomilled NiAl.
Figure 8A:
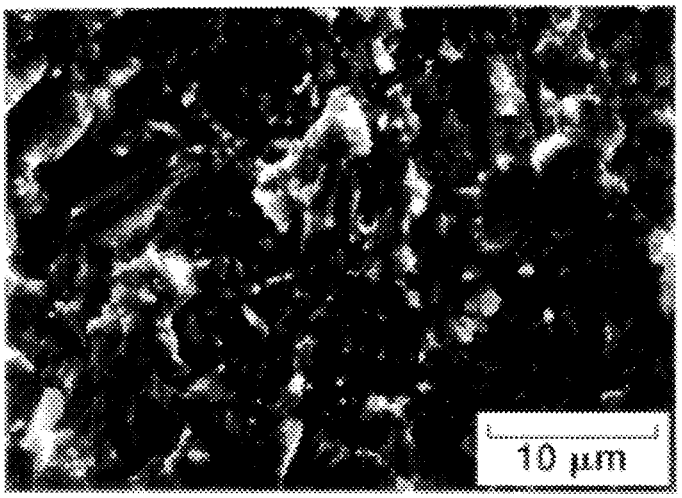
FIG. 8A is a fractograph of NiAl-8AlN.
Figure 8B:
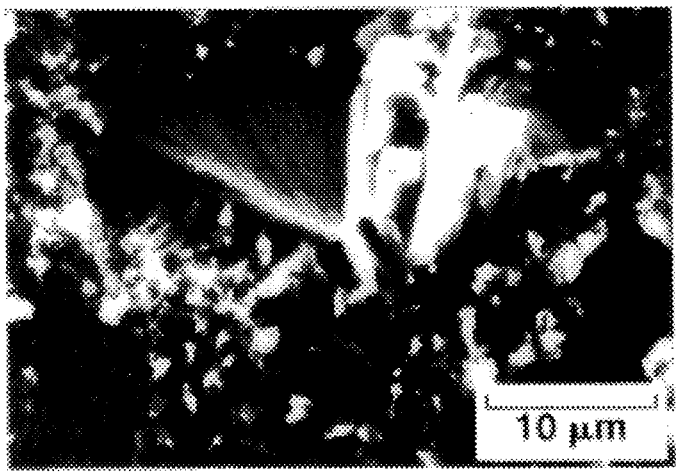
FIG. 8B is a fractograph of NiAl-30AlN.
Figure 9:
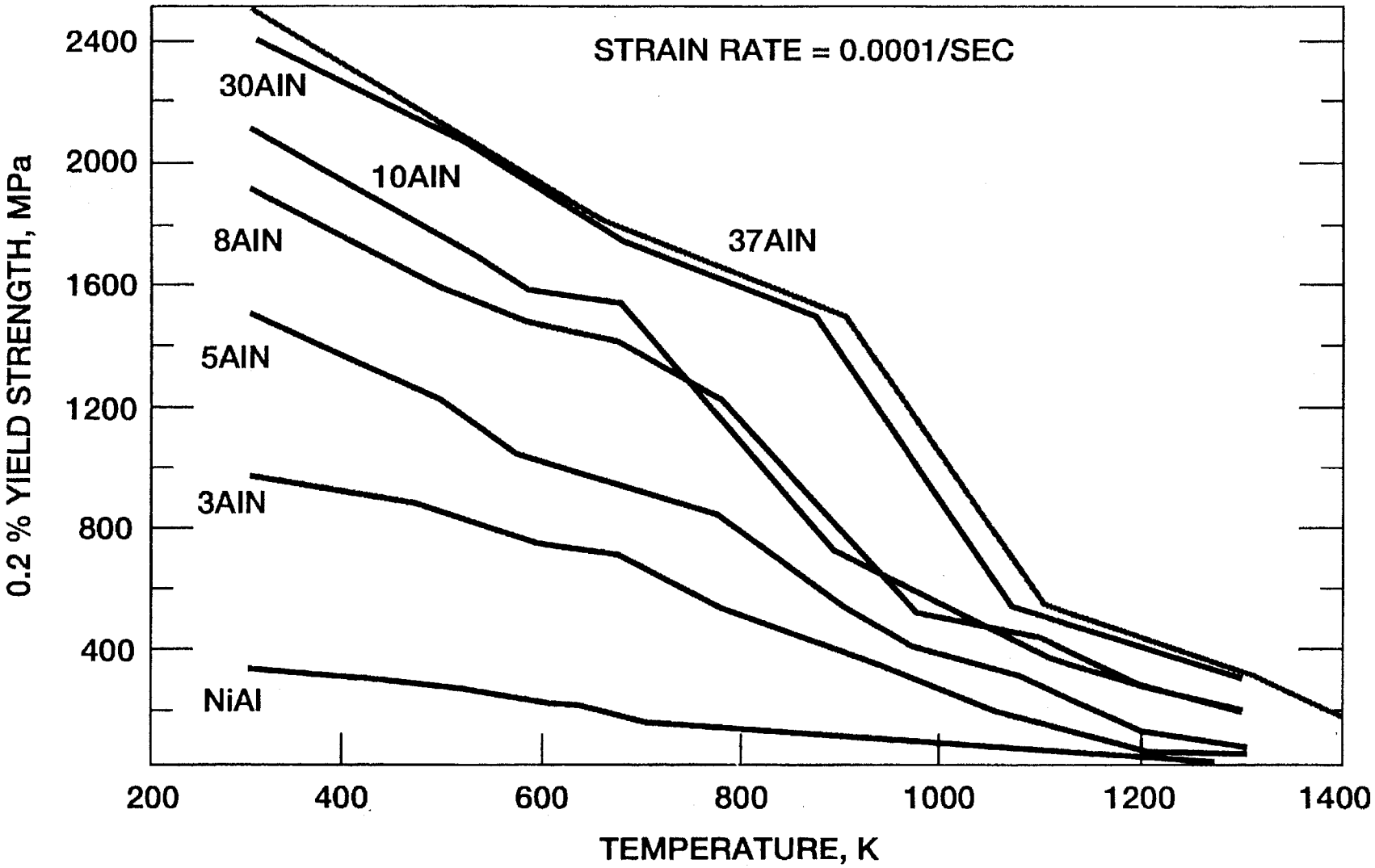
FIG. 9 shows compression strength versus temperature for NiAl-40AlN as compared to other NiAl-AlN alloys, indicating its superior strength.
Figure 10:
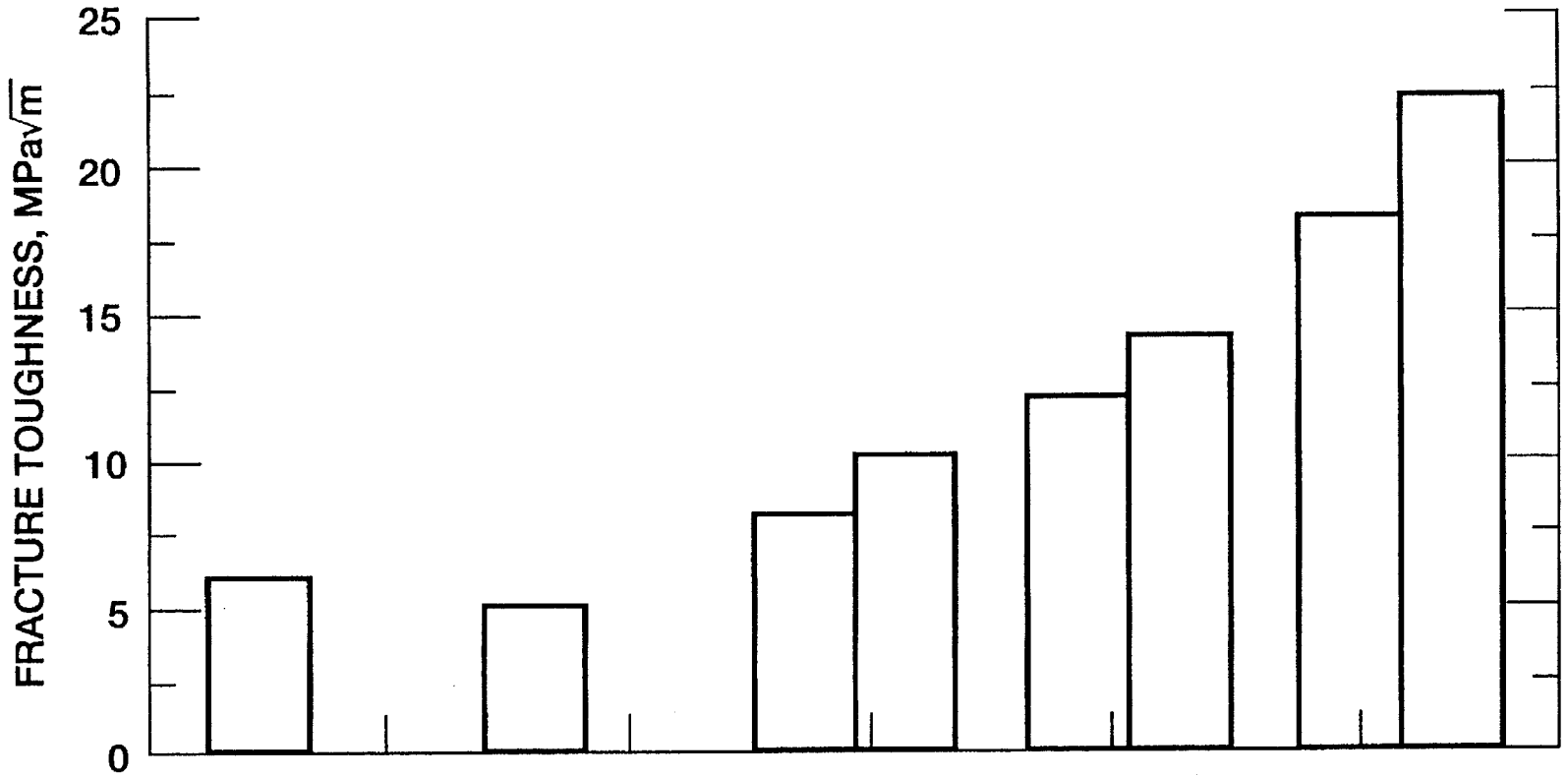
FIG. 10 shows the influence of ductile phase dispersion on room temperature toughness of NiAl-AlN.

The room temperature fracture toughness ($K_c$) measurements are made on chevron notched 4 point bend specimens tested in a universal test machine at a cross head speed of 0.01 mm per min. This cross head speed minimizes the overload effects. Fracture toughness is calculated from the load-displacement data using the slice model. FIG. 7D shows the variation of fracture toughness with variation in AlN content. (ϵ, NiAl; Δ, 3.0; ○5.0; •, 8.0; ■, 12.0 and ▲, 30.0). Fracture toughness values for binary NiAl are taken from several sources. FIG. 8A illustrates that the $K_c$ values of NiAl decrease insignificantly with increased AlN content. Scanning electron microscopic examination of fractured specimens indicate that NiAl-AlN exhibits predominantly transgranular cleavage fracture (see FIG. 8B). FIG. 9 shows the superior compressive yield strength of NiAl-40AlN compared to other NiAl-AlN alloys. FIG. 10 shows room temperature fracture toughness of NiAl based material. The FeCrAlY and NiCrAlY ductile reinforced materials show improved toughness over NiAl-AN. The NiCrAlY reinforcement shows the highest improvement (nearly 300% in toughness).

What is claimed is:

1. A particulate reinforced NiAl-AlN composite comprising:

a NiAl matrix having greater than about 13 volume percent particles of AlN therein and more than about 50 atom % aluminum.

2. The NiAl-AlN composite according to claim 1, wherein the NiAl matrix has about 55 atom % aluminum.

3. The NiAl-AlN composite according to claim 1, having an oxidation resistance at 1000 cycles and 1473 K of from about 5 mg/cm$^2$ to about 2 mg/cm$^2$.

4. The NiAl-AlN composite according to claim 1, having a thermal conductivity of from about 43 W/m·K to about 30 W/m·K.

5. The NiAl-AlN composite according to claim 4, wherein the thermal conductivity is about 35 W/m·K.

6. A particulate reinforced NiAl-AlN composite comprising:

a NiAl matrix having greater than about 13 volume percent particles of AlN therein and including a toughening alloy selected from the groups consisting of NiCrAlY, FeCrAlY and FeAl.

7. The composite alloy according to claim 6, wherein the toughening alloy is NiCrAlY.

8. The composite alloy according to claim 6, wherein the toughening alloy is FeCrAlY.

9. The composite alloy according to claim 6, wherein the toughening alloy is FeAl.

10. A method of preparing a particulate reinforced NiAl-AlN composite alloy comprising the steps of:

cryomilling, in an attritor with an impeller having an arm, prealloyed NiAl in liquid nitrogen using grinding media having a diameter of about 3 mm, an impeller speed of from about 450 rpm to about 800 rpm for a duration from about 4 hours to about 20 hours to obtain a cryomilled powder which forms upon consolidation a particulate reinforced NiAl-AlN composite alloy comprising a NiAl matrix having greater than about 13 volume percent particles of AlN within said matrix; and consolidating the cryomilled powder to form said particulate NiAl-AlN composite alloy.

11. The method according to claim 10, wherein the arm is in an inverted L shape.

12. The method according to claim 10, wherein the attritor has a capacity of greater than about 1.0 litres.

13. The method according to claim 10, wherein the impeller speed is about 800 RPM.

14. The method according to claim 16, wherein the cryomilling duration is about 16 hours.

15. The method according to claim 10, wherein the prealloyed NiAl contains from about 2 to about 6 atom % stoichiometric excess of Al.

16. The method according to claim 15, wherein the prealloyed NiAl contains about 5 atom % stoichiometric excess of Al.

17. A method of producing an improved low temperature toughness particulate reinforced NiAl-AlN composite according to claim 1, comprising the steps of:

cryomilling, in an attritor with an impeller having an arm, prealloyed NiAl and an alloy selected from the group consisting of prealloyed NiCrAlY, FeCrAlY and FeAl in liquid nitrogen under cryomilling conditions to obtain a cryomilled powder which forms upon consolidation a particulate reinforced NiAl-AlN composite alloy comprising a NiAl matrix having greater than about 13 volume percent particles of AlN within said matrix; and consolidating the cryomilled powder to form said particulate reinforced NiAl-AlN composite alloy.

18. The method according to claim 17, wherein the alloy is NiCrAlY and the low temperature toughness of the NiAl-AlN composite is from about 18 MPa to about 25 MPa√m.

19. The method according to claim 17, wherein the alloy is FeCrAlY and the low temperature toughness of the NiAl-AlN composite is from about 12 MPa√m to about 16 MPa√m.

20. The method according to claim 17, wherein the alloy is FeAl and the low temperature toughness of the NiAl-AlN composite is from about 8 MPa√m to about 10 MPa√m.

21. The method according to claim 17, wherein the cryomilling conditions comprise using grinding media having a diameter of from about 2 mm to about 6 mm, an impeller speed of from about 450 RPM to about 800 RPM for a duration of from about 4 hours to about 20 hours.

22. The method according to claim 21, wherein the grinding media has a diameter of about 3 mm.

23. The method according to claim 21, wherein the arm is in an inverted L shape.

24. The method according to claim 21, wherein the attritor has a capacity of greater than about 1.0 litre.

25. The method according to claim 21, wherein the impeller speed is about 800 RPM.

26. The method according to claim 21, wherein the cryomilling duration is about 16 hours.

27. The method according to claim 21, wherein the prealloyed NiAl contains from about 2 to about 6 atom % stoichiometric excess of Al.

28. The method according to claim 27, wherein the prealloyed NiAl contains about 3 atom % stoichiometric excess of Al.

29. The method according to claim 21, wherein the volume percent of the NiAl is from about 55% to about 85% and the volume percent of the AlN is from about 45% to about 15%.

* * * * *